US007982600B2

(12) United States Patent
Gavrila et al.

(10) Patent No.: US 7,982,600 B2
(45) Date of Patent: Jul. 19, 2011

(54) HYBRID COMMUNICATION TERMINAL-ALARM SYSTEM

(75) Inventors: Marian Gavrila, Ottawa (CA); Gabriel Patulea, Ottawa (CA)

(73) Assignees: Marian Gavrila, Ottawa (CA); Gabriel Patulea, Ottawa (CA)

( * ) Notice: Subject to any disclaimer, the term of this patent is extended or adjusted under 35 U.S.C. 154(b) by 2173 days.

(21) Appl. No.: 10/727,584

(22) Filed: Dec. 5, 2003

(65) Prior Publication Data

US 2010/0109866 A1 May 6, 2010

(30) Foreign Application Priority Data

Dec. 6, 2002 (CA) ..... 2411365

Mar. 5, 2003 (CA) ..... 2418612

(51) Int. Cl.
*G08B 1/08* (2006.01)

(52) U.S. Cl. ..... 340/539.22; 340/539.1; 340/539.11; 340/539.26

(58) Field of Classification Search ..... 340/539.1, 340/539.17, 539.11, 539.22, 539.26, 540
See application file for complete search history.

(56) References Cited

U.S. PATENT DOCUMENTS

| | | | | |
|---|---|---|---|---|
| 4,868,859 | A | 9/1989 | Sheffer | |
| 5,027,383 | A | 6/1991 | Sheffer | |
| 5,132,968 | A * | 7/1992 | Cephus | 370/349 |
| 5,446,445 | A | 8/1995 | Bloomfield et al. | |
| 6,011,967 | A | 1/2000 | Wieck | |
| 6,023,223 | A * | 2/2000 | Baxter, Jr. | 340/531 |
| 6,346,880 | B1 | 2/2002 | Schroeder et al. | |
| 6,697,645 | B1 * | 2/2004 | MacFarlane | 455/566 |
| 6,873,256 | B2 * | 3/2005 | Lemelson et al. | 340/539.1 |
| 6,948,653 | B2 * | 9/2005 | Beckert et al. | 232/45 |
| 7,005,982 | B1 * | 2/2006 | Frank | 340/539.26 |
| 7,109,859 | B2 * | 9/2006 | Peeters | 340/539.11 |
| 7,377,835 | B2 * | 5/2008 | Parkulo et al. | 455/521 |
| 7,424,527 | B2 * | 9/2008 | Petite | 709/224 |

FOREIGN PATENT DOCUMENTS

| | | |
|---|---|---|
| CA | 2036560 | 8/1992 |
| WO | WO-98/49663 | 11/1998 |

* cited by examiner

*Primary Examiner* — Davetta W Goins

(57) ABSTRACT

A hybrid communication terminal-alarm system is described, for individual use or for use in public facilities. A communication terminal, such as cellular telephone, personal digital assistant (PDA), fixed or mobile phone, etc, has one or more built-in alarm sensors. The sensors are capable of identifying various hazards and/or potentially dangerous events and appropriately warning the person(s) that may be affected, by the respective event. The alarm may be acoustic (e.g. a sound or a voice message) or optic (flashing light). The system also transmits automatically a distress message to a third party for help, as/if needed. The distress message may be transmitted over the public wireless or wireline network, or over a private network.

23 Claims, 4 Drawing Sheets

HYBRID COMMUNICATION TERMINAL-ALARM SYSTEM

PRIORITY PATENT APPLICATION

This patent application claims priority from the Canadian Patent Application SN 2,418,612 entitled "Hybrid Communication Terminal-Alarm System" (Gavrila et al.), filed Mar. 5, 2003, which in turn claims priority from Canadian patent Application 2,411,365, entitled "Cellular Telephone, Fixed Telephone or Personal Digital Assistant with Multiple Built-in Sensors" (Gavrila et al.) filed Dec. 6, 2002.

FIELD OF THE INVENTION

The invention is directed to security systems and in particular to a hybrid communication terminal-alarm system.

BACKGROUND OF THE INVENTION

Currently, there are many types of acoustic alarm systems activated upon detection of one or more predetermined events. These alarms are intended to protect the security of homes, automobiles, businesses, etc. and often alert police or specialized security companies of an unlawful entrance of the premises.

Also, it is known to use sensors for identifying potentially dangerous events, such as in smoke alarms, that sound whenever the smoke level in a building increases over a certain threshold. Fires cause approximately two-thirds of known fatalities, with automobile exhaust and faulty heating equipment causing the remaining one-third.

Presence of chemicals dangerous to humans is also alarmed based on chemical reactions. Thus, volatile compounds detectors detect various types of hazardous gases such as carbon monoxide, volatile amines, ammonia, nitrogen dioxide "G-type" nerve agents (sarin, soman and GF). These sensors are used in various types of alarms. It is for example known that CO (Carbon monoxide) is the leading cause of poisoning deaths in the U.S; annually 3,500 to 4,000 die of CO poisoning, and an estimated 10,000 people lose a day's work or seek medical attention.

Carbon monoxide CO is rapidly absorbed by the lungs and quickly passes to the blood, forming carboxyhemoglobin with the blood red cells (hemoglobin). The affinity of CO to hemoglobin is 20-270 times greater than the affinity of oxygen to hemoglobin. Hemoglobin carrying CO is incapable of releasing oxygen to the tissues. Even small amounts of carbon monoxide in the air will quickly increase the percentage of carboxyhemoglobin, reducing significantly the quantity of oxygen carried to the cells. For instance, breathing air with 0.01% (100 ppm) CO for two hours has been shown to increase blood carboxyhemoglobin concentrations to 16.0%, a concentration that will cause CO poisoning symptoms.

The U.S. Environmental Protection Agency reports that the majority of households in Canada and the U.S. are potentially at risk from CO poisoning from at least one hazardous source, e.g. the fireplace.

Recent advances in such areas as nano-technology, micro-electromechanical systems, micro-fluidics, micro-separations and opto-electronics present new technological possibilities for producing fast, extremely sensitive and inexpensive "smart" sensing systems. Advancements in micro-fabrication methods of silicon chips make it possible to produce sensor and biosensor arrays coated with specific sensing components with a high degree of reliability and at a low cost.

Current sensors are able to accurately detect chemical and biological agents at threshold concentrations in a maximum of 5 to 10 minutes. Reviews of the status of commercially available chemical and biological analytical instruments show that the chemical detectors are much more developed than the biological detectors. The chemical detectors are able to provide near real-time information about chemical agents (within seconds or minutes). They generally use transducer technologies including electrochemical, piezoelectric, colorimetric and optical systems.

The biosensors are devices that use biological molecules to detect other biological molecules of chemical substances. Biosensors with the specificity to distinguish target microorganisms in complex samples are also available today. For example, one FSU technology development project uses an instrument for trapping, separation, concentration and assay of bio-agents on the micrometer scale and is based on an AC electrokinetics technique. The operating principle is based on the polarizability of microorganisms, which depends strongly on their composition, morphology, and phenotype. Depending on the frequency of an applied electrical field, separation and detection of different bacteria, including viable and non-viable microorganisms is possible. Some potential benefits of this sensor are high sensitivity, automation, and compactness. Manufacture of pocketsize analyzers is also possible.

Unlike chemical agents, many living biological agents can reproduce, multiply inside the host and be passed from one host to another. The treat of biological weapons has been magnified in recent years due to the advances in the molecular biology, genetic engineering and related technologies as well as in the development of highly efficient delivery and dispersion systems. Both civilian and military sources predict that in the next 10 years, the treat from proliferation of biological weapons will increase dramatically. Early detection and warning methods for biological agents are paramount.

Nano-sensors are extremely small devices capable of detecting and responding to physical stimuli such as movement, light, force, acoustic, thermal, electromagnetic, etc. The stimuli may have dimensions in the order of one billionth of a meter.

There is a need to develop new technologies and systems for ensuring an adequate personal protection against various perils and to provide a prompt response to environmental haphazard, chemical or biological attacks/disasters.

SUMMARY OF THE INVENTIONS

It is an object of the present invention to provide a hybrid telecommunication terminal-alarm system (hereinafter called "Hybrid system"), which overcomes the shortcomings of the existing alarm systems.

Another object of the invention is to provide a hybrid system that identifies a hazardous event/situation and alarms the individuals exposed to such hazardous situation, and also alarms a third party for help.

Accordingly, the invention provides a hybrid communication terminal-alarm system, comprising: a communication terminal for connection to a communication network; means for monitoring the environment and providing a sensor reading signal indicative of the level of an environmental agent; an alarm mode controller for operating the communication terminal in an alarm mode according to the sensor reading sign.

A method for alarming presence of a hazardous agent is also provided according to this invention. The method comprises the steps of: equipping a communication terminal with means for monitoring the environment for generating a sensor reading signal indicative of the level of an hazardous agent;

and further equipping the communication terminal with an alarm mode controller for continuously comparing the sensor reading with a threshold, detecting a threshold violation and initiating an alarm mode protocol.

The invention also provides a method for alarming presence of a hazardous agent, comprising: equipping a communication terminal with means for detecting an dangerous level of an hazardous agent; and further equipping the communication terminal with an alarm mode controller for initiating an alarm mode protocol in response to a dangerous level of an hazardous agent.

Advantageously, the present invention is focused on the human being protection against various potential hazards, while using the existing communication facilities, which are largely deployed worldwide. As a result, the solution provided by the present invention is not expensive, and can be easily used at most locations and by most people. Evolution and miniaturization of the sensors enable the device of the present invention to alarm a large variety of perils. A hybrid communication terminal equipped with biosensors may for example detect presence of biological warfare agents (bacteria, viruses, fungi, and other living microorganisms that can kill or incapacitate). A hybrid communication terminal equipped with nano-sensors may for example detect radiological/nuclear particles and explosive powder.

Another advantage of the present invention is that the system may be utilized as an alarm system and also as a regular fixed, mobile, cellular, cordless and/or personal digital assistant (PDA) terminal. The device is especially useful for self protection or/and group protection in schools, kinder-gardens, public transportation, stadiums, bus and train stations, airports, subways, malls, etc.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, where.

DETAILED DESCRIPTION

The term "event" is used in this specification to designate a particular change from a normal environmental state to a dangerous state, such as a fire, high levels of CO or other hazardous gases, etc. The term "environmental agent" is used to define collectively dangerous biological and chemical agents as well as event such as fires, etc.

In accordance with an embodiment of the present invention, a communication terminal such as a fixed, cordless or cellular telephone, or a PDA is equipped with one or more of build-in detectors, each for sensing a particular event. The sensors readings are performed continuously, irrespective if the terminal is turned "on" or "off". If an event occurs when the terminal is turned "off", the terminal automatically turns "on", and once a hazardous event is detected, the hybrid terminal according to the invention switches from a normal mode of operation to an alarm mode of operation.

During the "normal mode" the hybrid terminal performs the functions provided for by its design, such as wireline or wireless communication, calculations, time/date information, memory, data organizer, etc, as well known.

While in the "alarm mode" of operation, the terminal issues an alarm, which warns the persons in the respective location of a respective event. The alarm may take a plurality of forms; it could be a vibration if the terminal is of the type carried in close proximity to the body (e.g. a pager), or can be an acoustic alarm (sound or message) or a visual alarm (blinking red light, etc).

In addition, in the alarm mode, the terminal establishes automatically a network connection with a preset telephone number, and transmits distress data that identifies at least the caller, the location of the caller and the type of alarm. In this way, help can be dispatched fast if necessary, or the person/s in the location of the event may be instructed how to proceed for minimizing the risks and/or the damages. A second preset telephone number may also be dialed automatically for at least some types of alarms, if communication with the first called number cannot be established.

Figure 1:
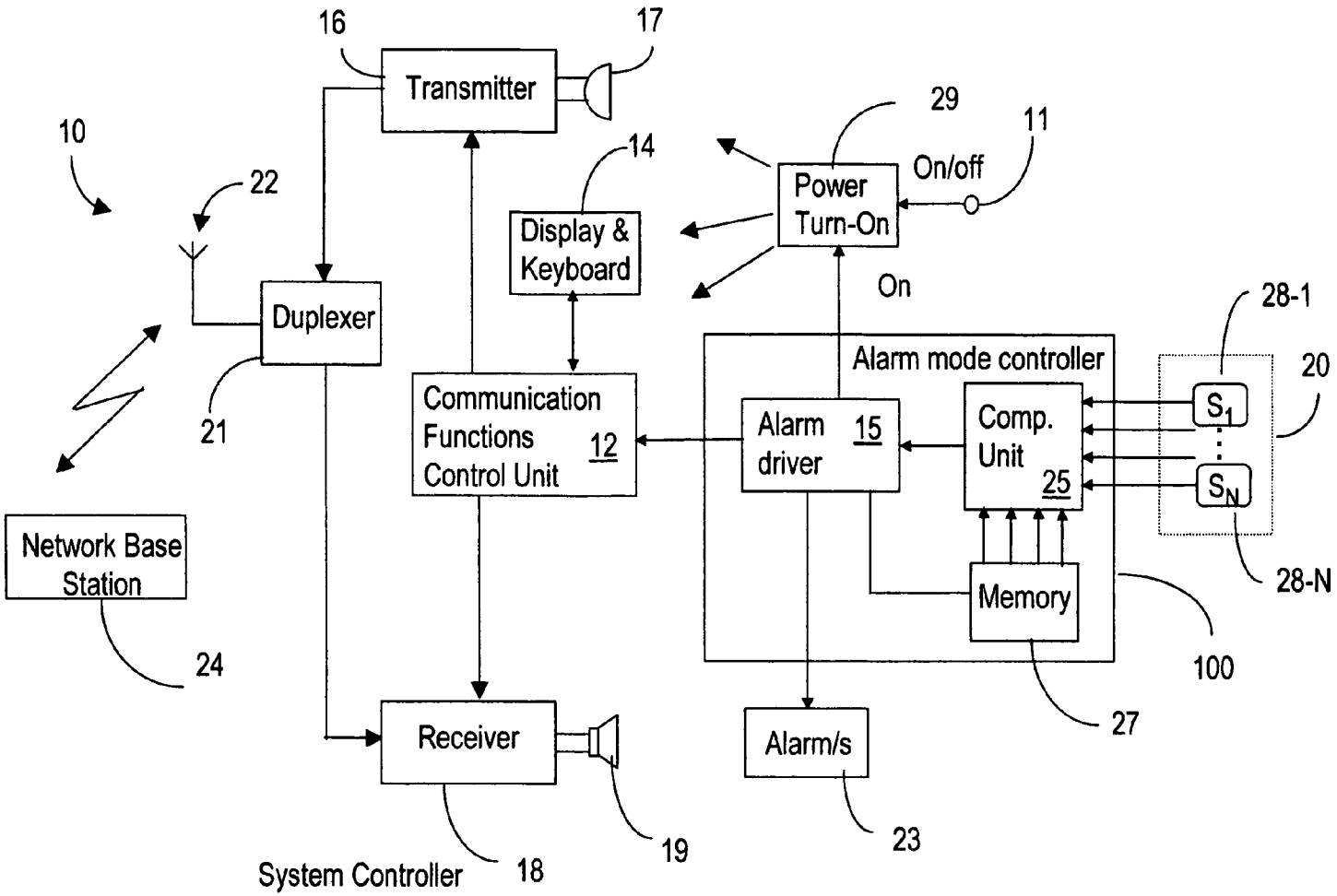
FIG. 1 is a block diagram of the hybrid communication terminal-alarm system according to an embodiment of the invention.

Referring now to the drawings, FIG. 1 is a block diagram of the hybrid communication terminal-alarm system according to an embodiment of the invention. This figure illustrates a cellular phone-alarm system. It is to be noted that, while the present invention is described as pertaining to the operation of a cellular telephone, the present invention may easily be applied to other types of mobile or fixed devices including, but not limited to, a PDA, pager, fixed telephone or fax machine, even laptop or desktop computers.

As shown, terminal 10 is comprised of a communication functions control unit 12, a display and keyboard module 14, a transmitting circuit 16 with its associated microphone 17 and a receiving circuit 18 with its associated speaker 19. As well known, a duplexer circuit 21 allows simultaneous connection of the transmitter and the receiver to the same antenna 22 that connects to the network base station (NBS) 24. Control unit 12 provides the means for carrying out the standard telephone functions of the cellular telephone or PDA 10, utilizing the respective permanently stored operation program. It is to be noted that CU 12 also carries other functions that may be available on cellular 10, but that are not related to the event alarming according to the invention. Such functions may for example provide storage for a number of telephone numbers and addresses, voice mail, messaging, e-mail, etc.

The input keys located on module 14 provide the means for entering numbers and related information. The transmitting circuit 16 transmits and the receiving circuit 18 receives RF signals via the antenna 22 to and from a cellular telephone NBS 24. The screed on module 14 also displays the number dialed, the calling number, e-mails and other information stored or received over the network, as well known. Since the particular construction and operation of module 14, transmitter 16, receiver 18, duplexer 21 and antenna 22 are well-known in the art, further description thereof is omitted herein, except where it is necessary for understanding the present invention.

According to the invention, the cellular 10 (or any other type of fixed and/or mobile communication device) is equipped with a multi-sensor block 20, comprising sensors 28-1 to 28-N, where $N \geqq 1$. Each sensor will alarm a particular event. Thus, the sensor 28-1 may designate a fire alarm sensor, 28-2 a CO sensor, 28-3 may designate a nano-sensor or a biological sensor, radiation sensor, etc. The present invention provides for a great degree of flexibility. Other sensors may be incorporated in block 20, as desired/necessary and as they become available. The sensors may provide either a digital or an analog reading. In the case of an analog reading, analog-to-digital converters need to be provided as explained later.

The terminal 10 is also provided with an alarm mode controller 100, a power turn-on unit 29 and alarm/s unit 23, described next.

Alarm mode controller 100 is equipped with a memory 27, which maintains a plurality N of thresholds for the respective maximum/minimum admissible value of the respective sensor readings. Preferably, these thresholds are not accessible to the user, but may be changed by the manufacturer as the knowledge of the acceptable limits evolves.

Alarm mode controller 100 also comprises a comparing unit 25 that receives the sensor readings from sensors 28 and the thresholds from memory 27 and provides an alarm signal whenever the comparison shows a dangerous level for the respective reading. Alternatively, sensors 28 may generate the alarm signal directly, if they are provided with the respective thresholds internally. The sensor that issues the alarm signal is declared "activated".

The alarm signal is applied to an alarm driver 15, which advantageously switches the operation of the terminal 10 into the "alarm mode". Also, driver 15 activates alarms 23, which can be, as discussed above audio, video, mechanical alarms. Speaker 19 may be used for the audio alarm; alternatively a dedicated speaker may be used by block 23.

In the alarm mode, unit 15 also drives control unit 12 to call a certain number pre-stored in memory 27. This can be the telephone number of an alarm company, or 911. For security reasons, a second distress number may also be provided if the first number is busy. To note that memory 27 is illustrated generically as a separate block; a person skilled in the art will understand that the thresholds and the distress numbers may be stored together with other functions provided for terminal 10.

The alarm signal also activates the power to the communication device, as shown by power turn-on unit 29. The sensors of unit 20, the comparison unit 25, and memory 27 are permanently powered to enable the readings and the comparisons, while unit 100 operates in a "sleep power mode", with a low power consumption.

Upon receiving a signal change on any of the alarm sensor's inputs, namely the alarm signal, alarm driver 15 wakes up, and checks whether the terminal is turned 'on' or 'off'. If it is turned 'off', then the terminal is turned 'on' and the alarm mode of operation sequence is performed, to allow automatic dialing of the distress number(s).

If the terminal is turned "on" and performs a normal communication routine or a certain function requested by the user, the current program routine is interrupted and the distress call takes priority over any other activity of control unit 12. Alarm driver 15 may also instruct control unit 12 to inform the calling party and/or the called party in a telephone conversation of the existence of an event, using messages pre-stored in memory 27.

Most cellular telephones use a microcontroller or microprocessor for implementing the communication functions. The additional functionality related to alarming events according to the invention may be incorporated in the respective microcontroller. Alternatively, separate units as shown in FIG. 1 may be used. In this case, the units 100, 20, 23 and 29 may be provided on a separate board. As well, alarm mode controller 100 may be provided by an ASIC.

Figure 2:
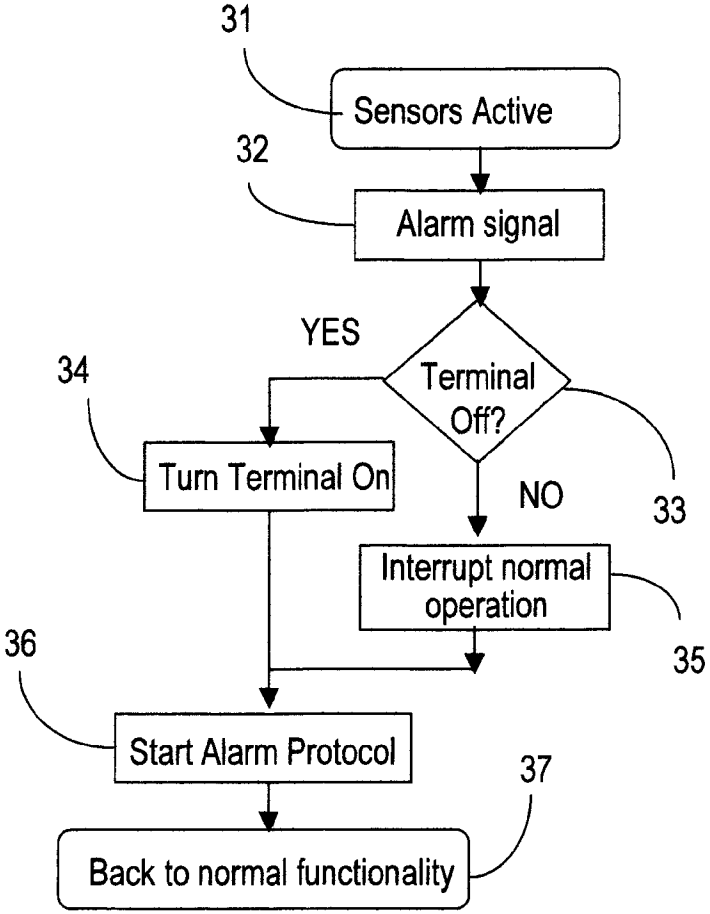
FIG. 2 is a flowchart of the operation of the embodiment shown in FIG. 1.

FIG. 2 is a flowchart of the operation of the embodiment shown in FIG. 1.

At step 31, the sensors take the respective environmental measurements (smoke, level of chemical and biological agents in the atmosphere, etc). Once an alarm signal issues as shown in step 32, alarm driver 15 wakes-up and checks if terminal 10 is turned "on" or "off", step 33. If the terminal is turned "off", unit 29 turns all the units of the terminal "on", step 34, and alarm driver 15 initiates the alarm mode protocol. If the terminal is "on" and performs a certain routine, that routine is interrupted as shown in step 35, and again, alarm driver 15 initiates the alarm mode protocol, shown in step 36.

As indicated above, the alarm specific procedure includes: generating an acoustic alarm (sound or message), mechanical (vibrations), or/and visual (printing the type of alarm on display 14) alarm, attempting to call an emergency pre-stored phone number over the network, or even an Internet address, and transmitting the associated alarm sensor code and the cellular telephone number or IP address (if available) to the emergency dispatcher.

In the case that the distress call came from a cellular phone, the operator will attempt to contact the cell phone owner in order to identify the location and to eventually assess the situation and advise.

After the alarm mode protocol has been performed, the terminal 10 returns to its normal mode of operation, as shown in step 37.

Figure 3B:
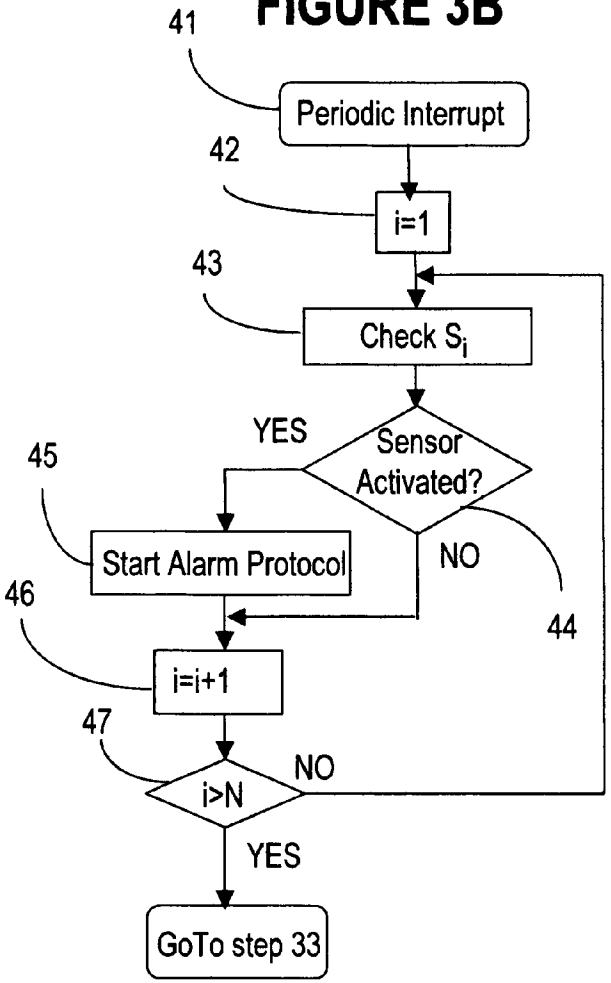
FIG. 3B is a flowchart of the pooling operation shown in FIG. 3A.
Figure 3A:
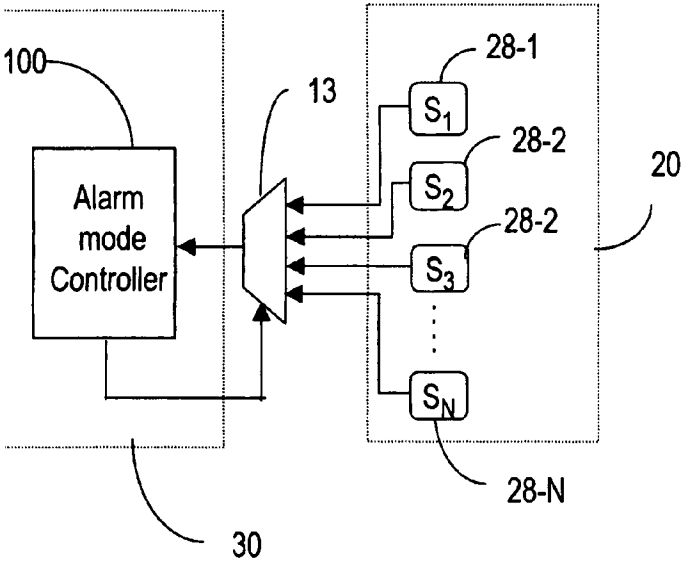
FIG. 3A is a schematic of an embodiment with digital sensors operating in a polling based environment.

FIG. 3A is a schematic of an embodiment with digital sensors operating in a polling based environment, and FIG. 3B is a flowchart of the pooling operation shown in FIG. 3A. As seen in FIG. 3A, the alarm sensors 28 include the thresholds and are connected to the alarm mode controller 15 of terminal 10 by means of a digital multiplexer 13 to extend the input/output capabilities while using a single input port of controller 100. The controller 100 has the capability to address the multiplexer 13 in order to select the reading of the appropriate alarm sensor. Depending on the actual controller configuration and external input/output port pins availability, the multiplexer could be omitted. In this case, the controller, under software control, reads each sensor's output individually through its own input/output pins. The multiplexer 13 may or may not be an external circuit to controller 100, or the controller may be provided with the capability of reading multiple alarm sensors 28 simultaneously.

As shown in FIG. 3B which details step 31 of FIG. 2, controller 100 periodically receives an alarm sensor related interrupt request. Following the interrupt request received in step 41, controller 100 initializes the index variable "i" which gives the number of the sensor being pooled, step 42. While executing the alarm sensor interrupt routine, the index variable "i" is also being sent to the multiplexer 13 addressing bus. After addressing the multiplexer 13, the controller 100 reads the data output from the multiplexer, which is the value provided by the respective pooled sensor $S_i$, step 43. As before, the alarm procedure is initiated in step 45, if the sensor is activated, as shown by branch YES of decision block 44. If the sensor is not activated, as shown by branch NO of decision block 44, the index variable is incremented (i=i+1), step 46, tested against the number of sensors N, step 47. If all sensors were pooled, branch YES of block 47, the control continues with step 33 of FIG. 2. If not, the controller continues to check the alarm sensor status as shown by branch NO of decision block 47.

If multiplexer 13 is not needed in a particular application, the alarm sensor reading is expected to be done through the controller's own input/output pins, in a similar manner like the multiplexed case.

Figure 4:
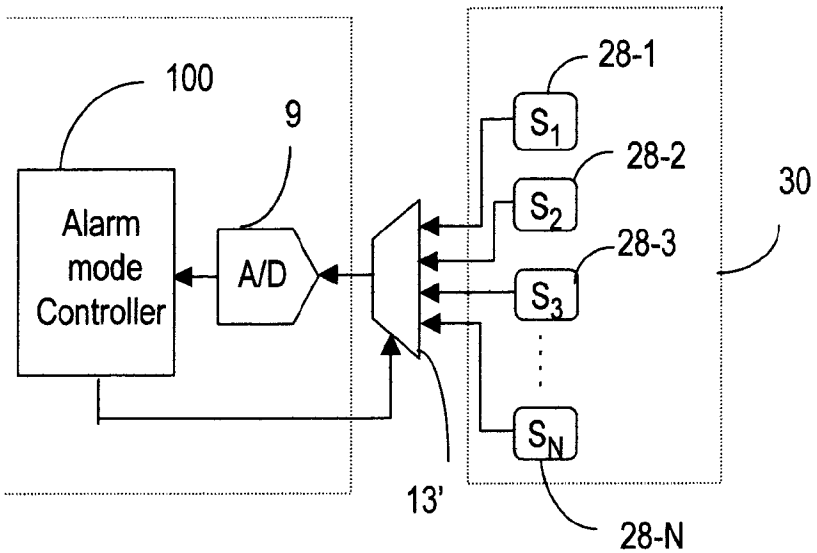
FIG. 4 is a schematic of an embodiment with analog sensors operating in a polling based environment.

FIG. 4 is a schematic of an embodiment with analog sensors operating in a polling based environment. In the embodiment of FIG. 4, an analog multiplexer 13' extends the input/output capabilities of the controller 100. As previously mentioned in the description of FIG. 3A, the controller has the ability to individually read each sensor through multiplexer addressing, with the difference that both the sensors and the multiplexer are analog in this embodiment. In this embodiment, an analog to digital converter 9 is used at the output of the multiplexer 13'.

If controller 12 is provided with enough inputs, then the analog multiplexer might not be needed. In this case, each input has to be converted from analog to digital. It is also to be noted that the A/D conversion may also be made by the controller 100 itself.

Figure 5:
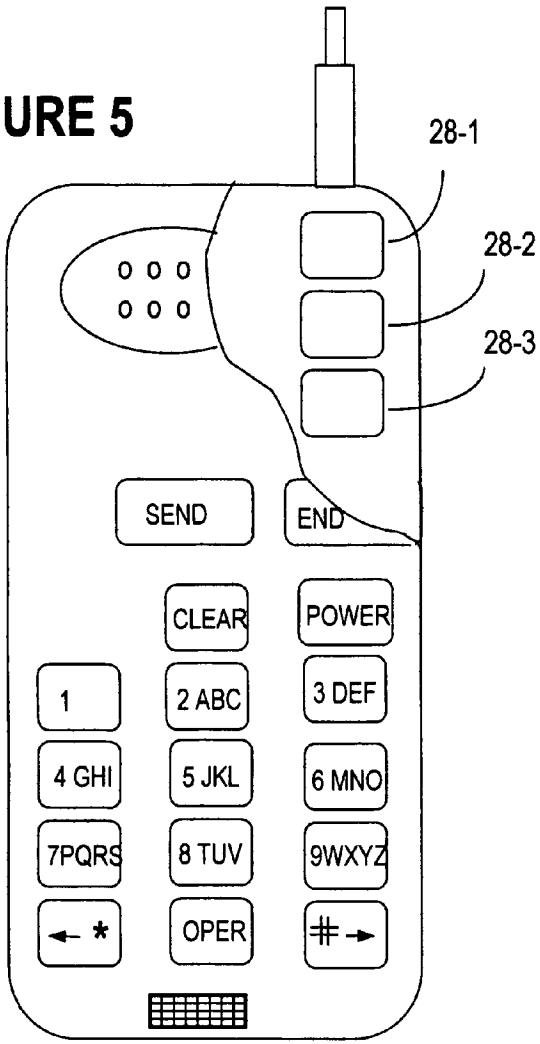
FIG. 5 is a schematic illustration of the cellular phone including a partial view of the circuit board and the built-in alarm sensors.

FIG. 5 is a schematic illustration of the cellular phone including a partial view of the circuit board and the built-in alarm sensors, which shows a possible placement of alarm sensors 28 on the printed circuit board 20 of a cellular phone.

Various other objects, advantages and features of the present invention will become readily apparent to those of ordinary skill in the art, and the novel features will be particularly pointed out in the appended claims.

We claim:

1. A mobile hybrid communication terminal-alarm system, for enabling access to a communication network in a normal operation mode and alarming presence of an environmental hazard in an alarm mode, comprising:

a communication terminal for connection to said communication network, adapted to exchange voice and data messages over the communication network;

a multi-sensor block for continuously monitoring the environment and providing a sensor reading signal indicative of a level of an environmental agent;

an alarm mode controller for operating said communication terminal in one of an alarm mode and in a sleep power mode according to said sensor reading signal; and a power turn-on unit for permanently powering said multi-sensor block during the sleep power mode and the alarm mode.

2. A system as claimed in claim 1, wherein said alarm mode controller comprises:

a memory for storing a threshold for indicating a hazardous level of said environmental agent;

a comparator unit for receiving said sensor reading signal from said multi-sensor block and said threshold from said memory and providing an alarm signal whenever said threshold is violated; and an alarm driver for receiving said alarm signal and initiating an alarm mode of operation sequence.

3. A system as claimed in claim 2, further comprising an alarm block.

4. A system as claimed in claim 3, wherein said alarm block provides one of an audio, video and mechanical alarm.

5. A system as claimed in claim 2, wherein said alarm driver triggers transmission of a distress signal for establishing an automatic connection over said network using said mobile communication terminal on receipt of said alarm signal.

6. A system as claimed in claim 1, wherein said multi-sensor block includes one of a smoke detector, a chemical agents detector, a radiation detector and a biological agent detector.

7. A system as claimed in claim 1, wherein said multi-sensor block comprises a plurality of sensors, each for monitoring presence of a specific environmental agent.

8. A system as claimed in claim 1, wherein said the multi-sensor block is a biosensor array.

9. A system as claimed in claim 1, wherein said multi-sensor block is a digital sensor.

10. A system as claimed in claim 1, wherein said multi-sensor block is an analog sensor, further comprising an analog-to-digital converter for formatting said sensor reading signal.

11. A system as claimed in claim 5 wherein said mobile communication terminal comprises a communication functions control unit for generating said distress signal, encoding said distress signal into an outgoing message using a communication protocol, and sending said message over said communication network to a specified location.

12. A system as claimed in claim 1, wherein said mobile communication terminal includes a receiver for enabling reception of incoming messages over said network.

13. A system as claimed in claim 1, wherein said mobile communication terminal further comprises a keyboard for enabling transmission of alphanumeric messages over said network and a display for enabling reception of video messages over said network.

14. A system as claimed in claim 1, wherein said mobile communication terminal is one of a cellular telephone, a cordless telephone, a pager and a fax machine.

15. A system as claimed in claim 1, wherein said mobile communication terminal is one of a personal digital assistant, a laptop equipped with a communication functions control unit for generating a distress signal, encoding said distress signal into an outgoing message using a communication protocol, and sending said message over said communication network to a specified location.

16. A system as claimed in claim 1, wherein said multi-sensor block comprises a plurality of sensors (Sn) and a multiplexer for providing the sensor reading signal from any sensor of the plurality of sensors on a single input of said alarm mode controller.

17. A method for alarming presence of a hazardous agent, comprising:

equipping a mobile communication terminal, with a multi-sensor block for monitoring the environment and generating a sensor reading signal indicative of a level of the hazardous agent, the mobile communication terminal being used in a normal operation mode for communicating voice and data over a communication network;

operatively integrating a power turn-on unit with said mobile communication terminal for permanently powering said multi-sensor block; and further equipping said communication terminal with an alarm mode controller for continuously comparing said sensor reading signal with a threshold, detecting a threshold violation and initiating an alarm mode protocol.

18. A method as claimed in claim 17, wherein said alarm mode protocol performs the steps of:

turning 'on' said mobile communication terminal if turned 'off';

interrupting normal operation mode of said mobile communication terminal if performing a normal communication routine;

transmitting a distress signal by establishing an automatic connection over the communication network using said mobile communication terminal; and providing an alarm to indicate said threshold violation.

19. A method as claimed in claim 18, wherein said distress signal includes an identification of said mobile communication terminal and an information on the present location of said communication terminal.

20. A method as claimed in claim 18, further comprising indicating the gravity of said threshold violation.

21. A method as claimed in claim 17, wherein said multi-sensor block is permanently powered, while said alarm mode controller operates in a sleep power mode whenever said communication terminal is turned 'off'.

22. A method as claimed in claim 17, further comprising receiving, at the mobile communication terminal, instructions over said communication network regarding immediate protective measures for minimizing the effects of said hazardous agent.

23. A method as claimed in claim 17, further comprising:

equipping said multi-sensor block with a plurality of detectors specialized for measuring and alarming presence of a plurality of respective environmental agents;

multiplexing a plurality of detector measurements on an input of said alarm mode controller; and reading continuously and sequentially said detector measurements to detect any dangerous level of any of said environmental agents.

* * * * *